US007328550B2

(12) United States Patent
Floding et al.

(10) Patent No.: US 7,328,550 B2
(45) Date of Patent: Feb. 12, 2008

(54) METHOD FOR PACKAGING ARTICLES USING PRE-PERFORATED HEAT SHRINK FILM

(75) Inventors: Daniel Leonard Floding, Alexandria, MN (US); Richard Jerome Schoeneck, Alexandria, MN (US); Irvan Leo Pazdernick, Alexandria, MN (US); Ronald Matthew Gust, Miltons, MN (US); Bruce Malcolm Peterson, Alexandria, MN (US)

(73) Assignee: Douglas Machine Inc., Alexandria, MN (US)

( * ) Notice: Subject to any disclaimer, the term of this patent is extended or adjusted under 35 U.S.C. 154(b) by 112 days.

(21) Appl. No.: 11/185,116

(22) Filed: Jul. 20, 2005

(65) Prior Publication Data

US 2005/0247031 A1 Nov. 10, 2005

Related U.S. Application Data

(63) Continuation of application No. 10/680,463, filed on Oct. 7, 2003, now abandoned.

(60) Provisional application No. 60/473,372, filed on May 23, 2003.

(51) Int. Cl.
*B65B 53/02* (2006.01)

(52) U.S. Cl. ..... 53/442; 53/557

(58) Field of Classification Search ..... 53/442, 53/557

See application file for complete search history.

(56) References Cited

U.S. PATENT DOCUMENTS 3,014,320 A * 12/1961 Harrison ..... 53/487
3,222,800 A 12/1965 Siegel et al.
3,349,502 A 10/1967 Kiefer
3,357,153 A 12/1967 Shaffer
3,545,165 A 12/1970 Greenwell
3,721,804 A 3/1973 Feldman
3,830,036 A 8/1974 Harkness et al.
3,855,890 A * 12/1974 Lynch et al. ..... 83/331
3,866,331 A 2/1975 Evans, Jr.
3,866,386 A * 2/1975 Ganz ..... 53/398
3,897,671 A 8/1975 Higgins
4,050,216 A * 9/1977 Stenberg ..... 53/413
4,830,895 A * 5/1989 Bernard ..... 428/34.2
5,050,368 A 9/1991 Noh
5,765,336 A 6/1998 Neagle et al.
6,281,471 B1 8/2001 Smart
6,340,806 B1 1/2002 Smart et al.
6,514,448 B1 2/2003 Vogel et al.
D481,049 S 10/2003 Limousin (Continued)

FOREIGN PATENT DOCUMENTS

GB 2227473 A * 8/1990

OTHER PUBLICATIONS

California Polytechnic State University Website, "Organic Analysis: Infrared Spectrophotometry," on-line publication, printed Sep. 16, 2003 (publication date unknown), 5 pages.

(Continued)

*Primary Examiner*—Stephen F. Gerrity
(74) *Attorney, Agent, or Firm*—Alan Kamrath; Kamrath & Associates PA

(57) ABSTRACT

A method for enclosing articles in heat-shrink film and for perforating or slitting the heat shrink film.

20 Claims, 8 Drawing Sheets

U.S. PATENT DOCUMENTS

| | | | |
|---|---|---|---|
| 6,646,669 | B2 | 11/2003 | Gelbart |
| 6,648,634 | B2 | 11/2003 | Nava |
| 6,653,041 | B2 | 11/2003 | Payne et al. |
| 6,654,042 | B2 | 11/2003 | Ikeda |
| 6,672,470 | B2 | 1/2004 | Wurster et al. |
| 6,689,180 | B1 | 2/2004 | Liao |
| 6,772,575 | B2 | 8/2004 | Limousin |
| 2004/0123566 | A1 | 7/2004 | Limousin |

OTHER PUBLICATIONS

Smiths Detection Website, "Disposable Cards for IR & FT-IR Spectroscopy," on-line product catalog, printed Sep. 16, 2003 (publication date unknown), 1 page.

International Crystal Laboratories Website, "PTFE & Polyethylene IR Sample Cards," on-line product catalog, printed Sep. 16, 2003 (publication date unknown), 2 pages.

Lucent Technologies/Bell Labs Innovations Website, "Bell Labs researchers build novel semiconductor laser using photonic crystal," on-line press release, Oct. 31, 2003, 3 pages.

J. Faist, F. Capasso, C. Sirtori, D.L. Sivco, J.N. Baillargeon, A.L. Hutchinson, S.N.G. Chu and A.Y. Cho, "Quantum design of QC-laser," Appl. Phys. Lett. 68, pp. 3680-3682 (1996), and index (1 page).

* cited by examiner

METHOD FOR PACKAGING ARTICLES USING PRE-PERFORATED HEAT SHRINK FILM

The present application is a continuation of co-pending application Ser. No. 10/680,463, filed Oct. 7, 2003, now abandoned, which claims benefit of application Ser. No. 60/473,372, filed May 23, 2003.

BACKGROUND OF THE INVENTION

The present invention is directed to a method for packaging articles using shrink-wrap film, and particularly to an invention using pre-perforated film.

It is known in the art to overwrap articles in a web of heat shrinkable film to form a multipack package by separating a tube of such film wrapped around spaced groups of articles along a weakened zone by shrinking the tube adjacent the zone and then by shrinking the tube section formed thereby around the articles to form a package. See U.S. Pat. No. 3,545,165.

Previous methods of packaging such as the above have involved feeding the groups of articles into a heat tunnel in series, with the film wrapped around the articles from the leading edge of the group to the trailing edge of the group. FIG. 1 shows how this is typically accomplished. Groups G of articles A are placed spaced apart on a conveyor C. A layer L of film F (usually from a roll of film) is wrapped around the groups G with the film layer L continuously covering adjacent groups G.

The groups G are then fed on the conveyor into a heat tunnel T. Heat and (typically) forced air is applied to the junction J between adjacent groups, causing the film layer L to soften at the junction J and pinch off between the groups, at the same time shrinking tightly against the groups G as shown. This results in complete packages P of articles A, with the film shrunk about them. The closed ends E of the packages (known as "bulls eyes") are at ends of the packages in the direction of travel of the conveyor (shown by the arrow).

An extension to the above apparatus is shown in FIG. 2. Here, parallel conveyors C1, C2, C3, etc. carry article groups G1, G2, G3, etc. into the heat tunnel, where the above-described heat-shrinking occurs. The parallelism improves total throughput.

The apparatus shown in FIGS. 1 and 2 has a number of disadvantages. In gathering of multiple articles A into the groups G (known as "pack patterns"), the continuous tube of film creates design challenges to support the groups from the underside while the tube of film is formed around the product. This is further complicated by product size changeover requirements. Theoretically, the conveyor C that transports the product pack pattern into the heat tunnel would have to change widths for each change in product size to accommodate the tube of film around the pack pattern.

In yet another variation, cut sleeves of film F are used, one sleeve per article group, instead of a continuous layer of film F over the groups G. However, the groups G are fed serially into the heat tunnel T with the articles A in each group G oriented in such a manner that the film F will be shrunk around each group G with the resulting closed ends E ("bulls eyes") oriented transverse to the direction of travel of the conveyor C. To improve throughput, multiple parallel streams of articles A may be fed into the heat tunnel.

This apparatus, too, has disadvantages. Cutting the film into multiple streams can cause a loss in cutting efficiency. Narrow streams of film are generally more "stretchy" than one wide, non-split web of film. This varies film tension and can cause cutting problems and film alignment problems. Cutting (splitting) the film into multiple streams also requires that the apparatus guide each stream apart from each other so the streams do not stick together when processing through the heat tunnel.

There is a need for a method and apparatus of packaging that addresses the above problems.

When shrink wrapping parallel streams of product, a single web of film is wrapped around the packages. This web is perforated and partially slit to match the product streams. The product may be fed into the film shrinking apparatus in parallel streams to increase throughput. The same machine will often be capable of running a single stream of large packages, or multiple streams of smaller packages. A single large roll of shrink wrap film may be used. If the film is printed with graphics, the graphic pattern will match the number of streams of product being processed. In one type of product stream, the web of film is perforated between the product streams, forming a weakened area between the streams. The individual streams of packages must be separated into individual units. The weakened areas between the packages pull apart as the film shrinks in the heat tunnel.

The current standard is to completely slit the film into individual webs for each product stream. This requires that the webs be separated transversely. A spreader bar performs this function. The spreader bar must be adjusted for different stream patterns. The spreader bar adds drag to the film which causes web stretch, which can disrupt film registration. By perforating the film web instead of fully slitting it, the spreader bar and all of its issues can be eliminated.

The wrapper mechanism sometimes fails to place the film under a package. A photo-eye is used to detect the absence of the film as the wrapping wand carries the film over the top of the package. When multiple split streams are used, a photo-eye is required for each stream. When changing from single to multiple streams, the photo-eyes may have to be adjusted to align with the individual web paths. When using a single perforated web, the wrapping acts as if on a single sheet so that the sheet will entirely wrap or entirely miss. The absence of the sheet can be detected by one photo-eye which can be mounted in a fixed position.

As the wrapper wand places the film over the product, the film can become angled and not wrap squarely. The problem is worse when the film width is narrow compared to the length.

There is a need for an apparatus for creating perforations in the web of shrink wrap film prior to the wrapped articles entering the film shrinking apparatus.

It has been found that the film which is at the bottom of the package tends to weaken more slowly, sometimes preventing the packages from fully separating. The problem is reduced by fully slitting the film in this region before it is wrapped around the product.

There is thus a need for a film slitter for fully slitting the film that will encounter the bottom of the package before it is wrapped around the product.

U.S. Pat. No. 5,771,662 discloses a rotary cutter for cutting laterally extending cuts and perforations across heat shrink film. However, such a cutter is not usable in creating perforations in heat shrink film along the length of the film, so that the film separates along the perforations and shrinks against the packages.

SUMMARY OF THE INVENTION

A method for packaging articles using pre-perforated heat-shrink film and perforating and slitting the heat shrink film. The method uses an apparatus including a rotating perforating wheel having a number of sharpened teeth, with dull portions between the teeth, and a slitter for slitting the film.

A principle object and advantage of weakening the film between packages is that it results in a better package appearance.

A principal object and advantage of the present invention is that the same conveyor can be used for a variety of product sizes and stream multiples.

Another principal object and advantage of the present invention is that parallel packages of product may be run through the heat tunnel with much less risk of the parallel packages sticking to each other.

Another principal object and advantage of the present invention is that it improves throughput while simplifying the apparatus.

Another principal object and advantage of the present invention is that it produces more aesthetically pleasing "bulls eyes."

Another principle object and advantage of weakening the film between packages is that the film between packages is supported during the shrink which prevents it from wrinkling and self-adhering.

Another principle object and advantage of the present invention is that by perforating the web instead of slitting, it acts as one wide sheet instead of multiple narrow sheets. This improves the alignment of the wrap.

DETAILED DESCRIPTION OF THE PREFERRED EMBODIMENT

Figure 1:
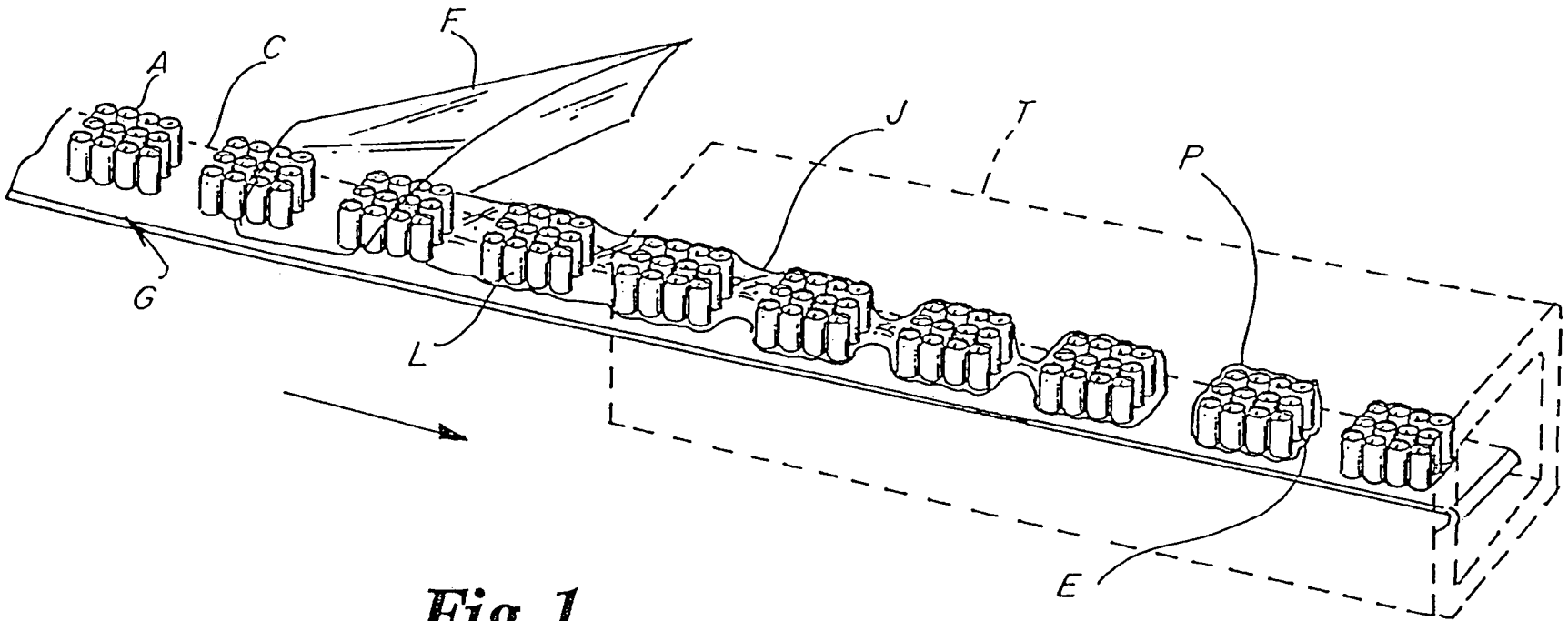
Fig. 1. PRIOR ART
FIG. 1 is a perspective conceptual view of a packaging apparatus of the prior art.
Figure 2:
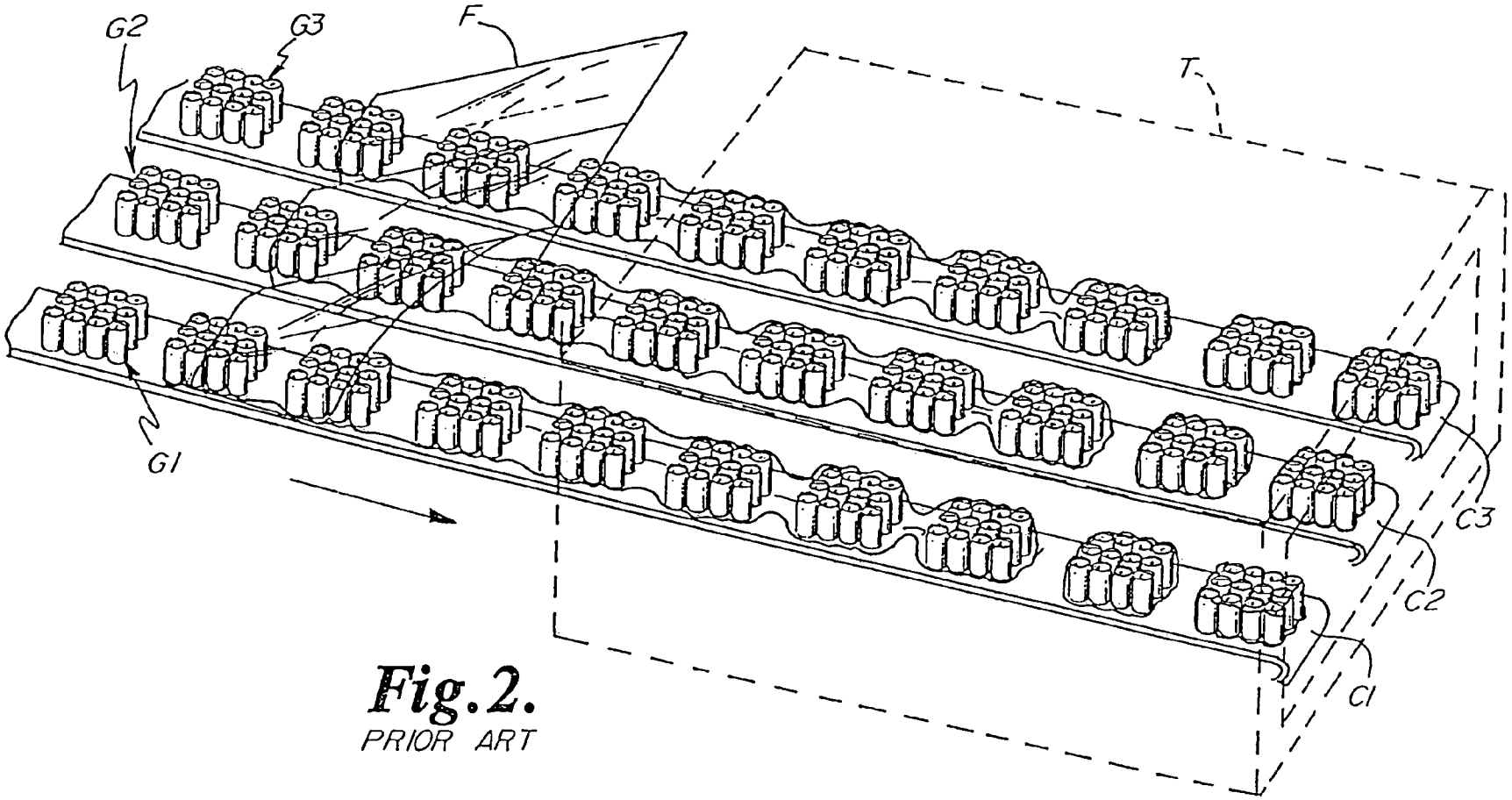
Fig. 2. PRIOR ART
FIG. 2 shows another embodiment of the prior art apparatus of FIG. 1.
Figure 3:
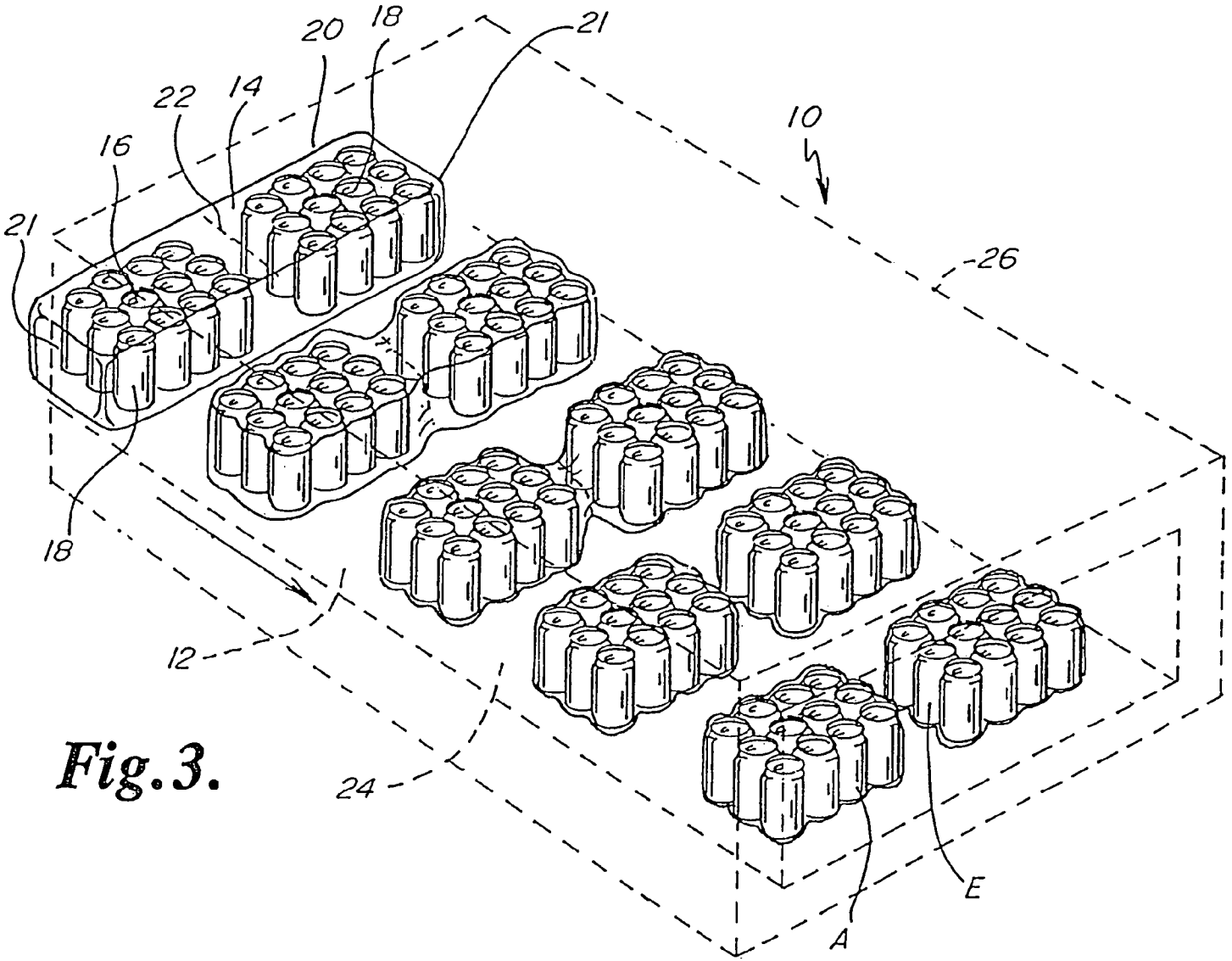
FIG. 3 is a perspective conceptual view of the apparatus of the present invention.
Figure 4:
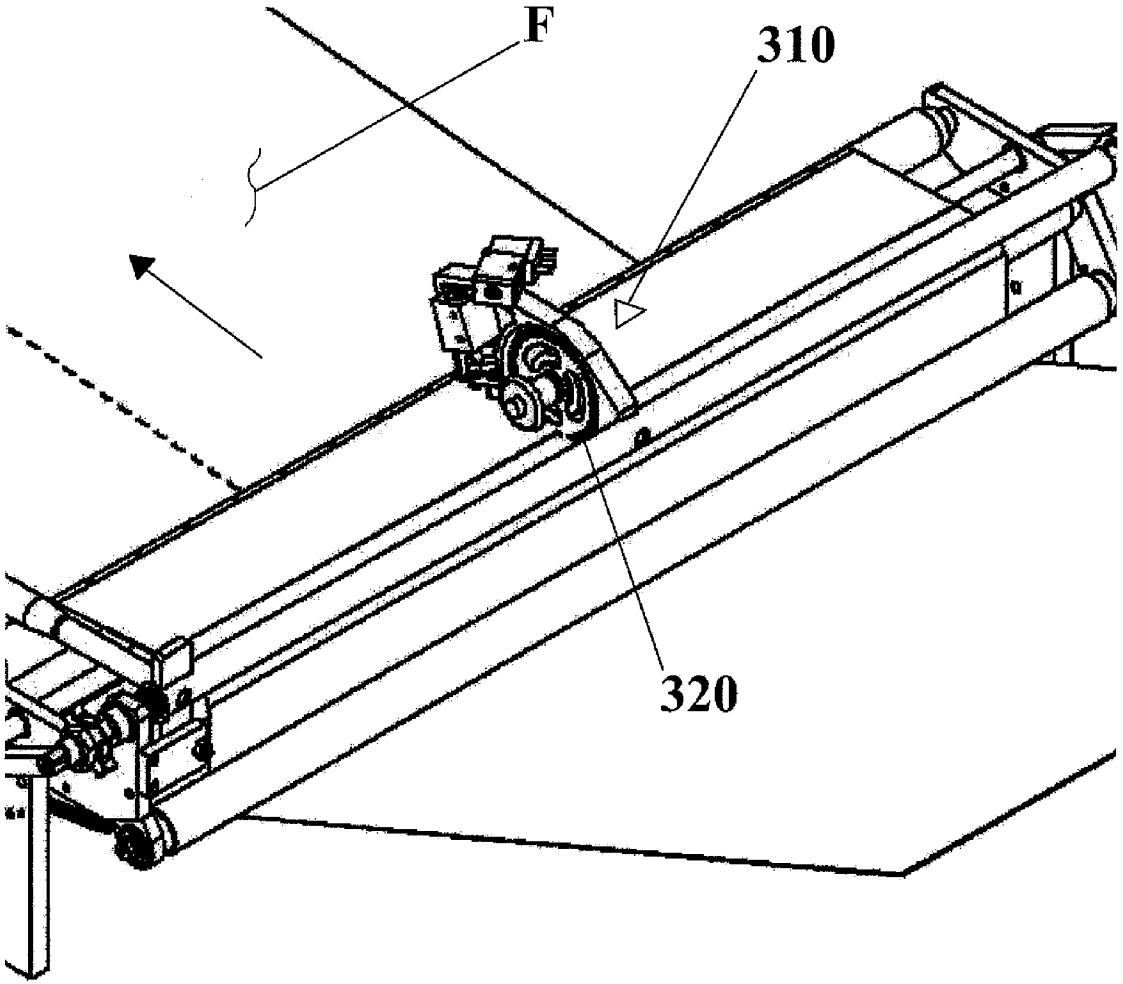
FIG. 4 is a perspective view of an apparatus used with the present invention.
Figure 5:
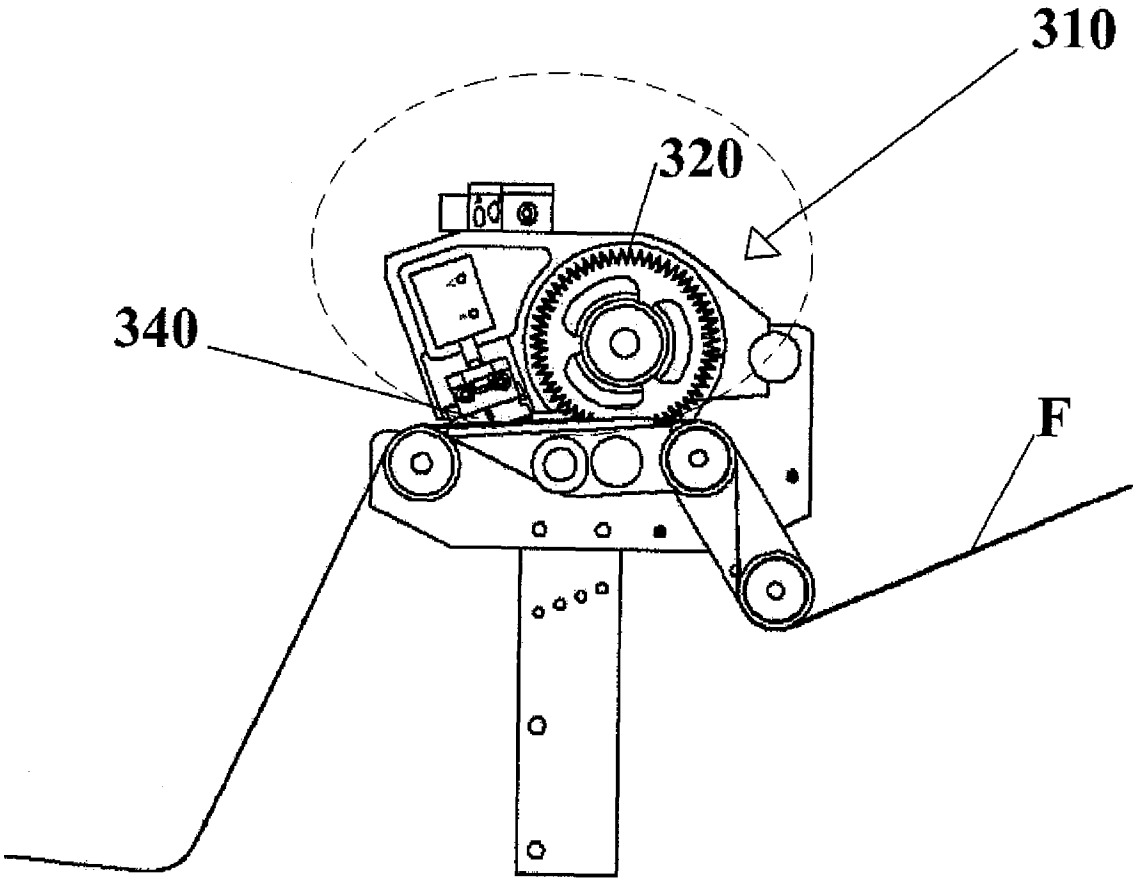
FIG. 5 is a side elevational view of the apparatus used with the present invention.
Figure 6:
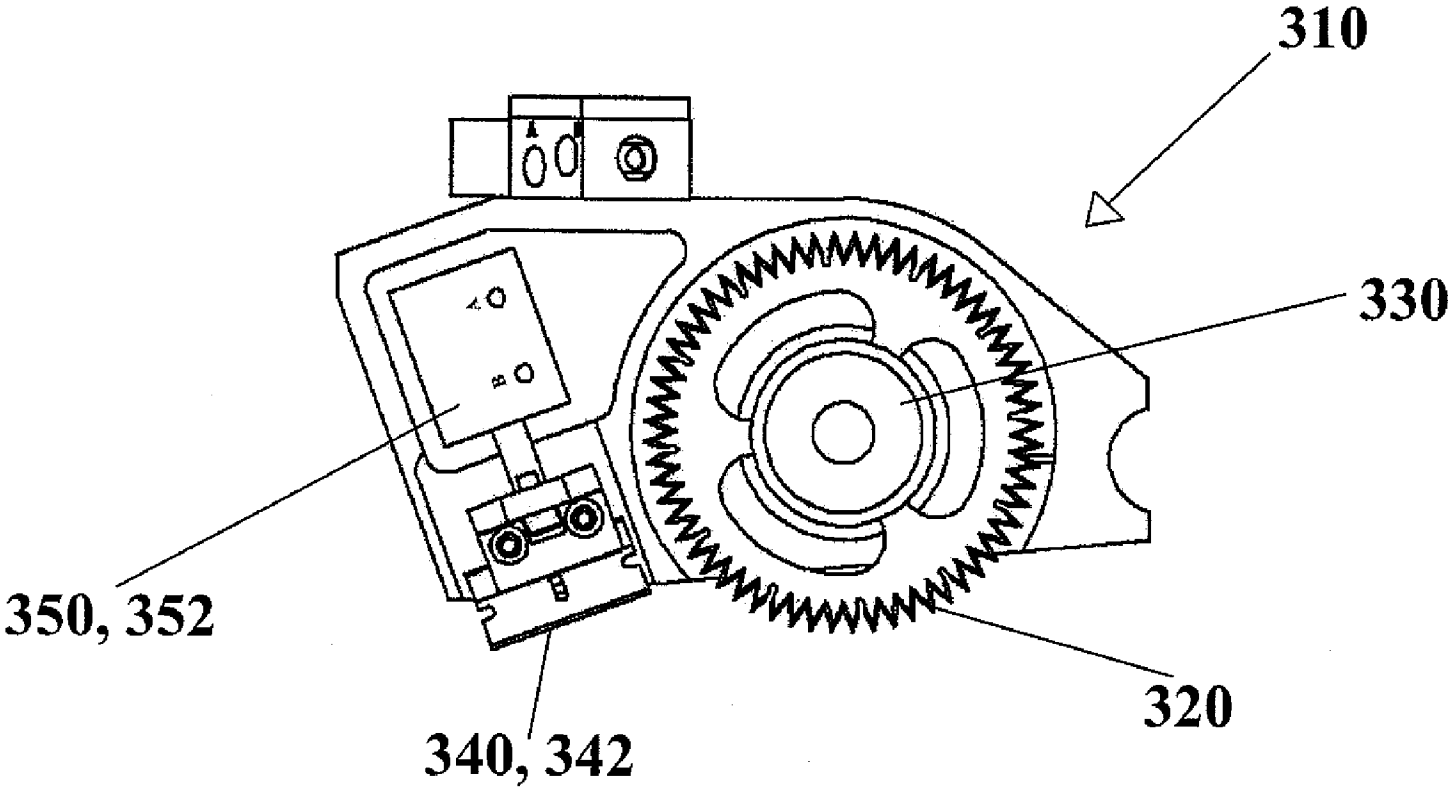
FIG. 6 is a detailed view of the dashed area of FIG. 5.
Figure 7:
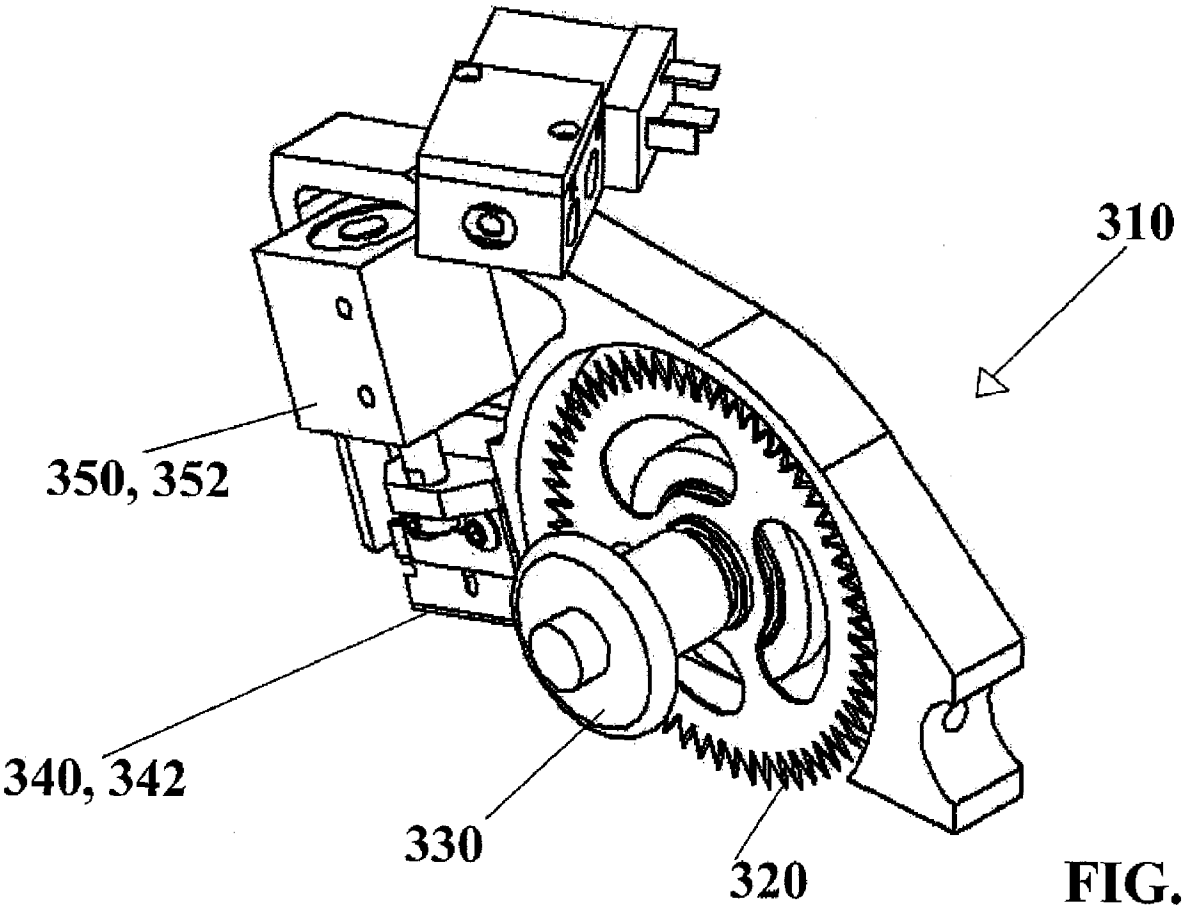
FIG. 7 is a detailed perspective view of the apparatus used with the present invention.
Figure 8:
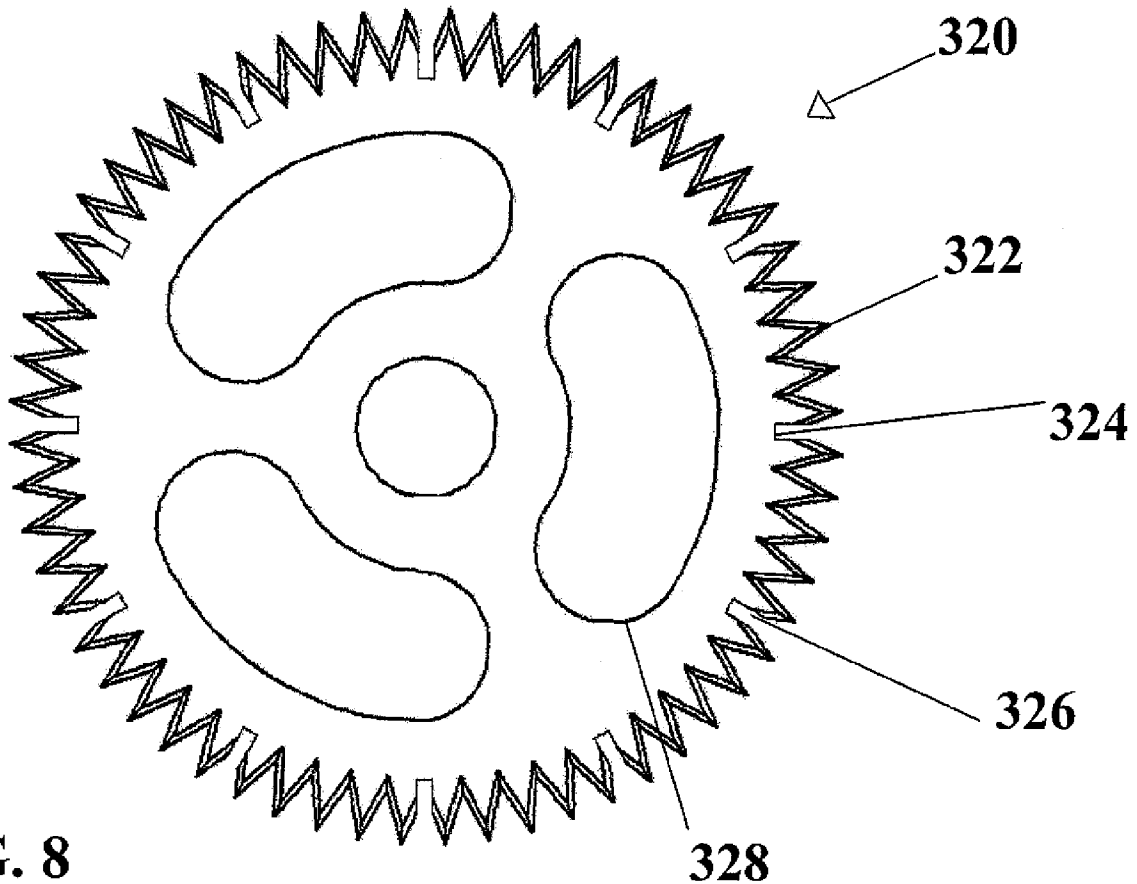
FIG. 8 is a plan view of the perforation wheel of the apparatus used with the present invention.

An apparatus according to the present invention is illustrated first in F*ig*. 3 and generally designated 10. In the present invention, an appropriate mechanism is used to create a line of perforations in a sheet of heat-shrink, film. The perforated heat-shrink film is then wrapped around parallel packs 18 of groups 14 of articles 16 spaced apart from one another by a spacing 24. The parallel groups 14 are then enclosed in the heat-shrink film with the line of perforations 22 between the parallel groups 14, thereby forming a continuous, sleeve 20 of film.

The groups 14 are placed onto a conveyor 12 in an orientation such that the open ends 21 of the sleeve 20 of film are oriented substantially transverse to the direction of motion of the conveyor 12 (indicated by the arrow).

Heat energy is then applied to the continuous sleeve 20 of film to weaken the sleeve 20 at the line of perforations 22, the sleeve 20 then pinching off at the line of perforations and becoming shrunk against the articles 16 to create individual packages A and E. In the preferred embodiment, a heat tunnel 26 is used to apply the heat energy, but any other suitable means could be used. The previously open ends 21 become the "bulls eyes" of the packages.

Because the packs 18 of groups 14 are placed on the conveyor with the film sleeve pre-wrapped around them, the present invention removes the problem of having to change the width of the conveyor to handle change in product size. That is, the packs 18 are oriented transverse to the direction of motion of the conveyor 12, so that the full width of the conveyor 12 is used, regardless of product size.

Because the present invention achieves parallelism without the need for guiding streams of film serially into the heat tunnel with the streams spaced apart from each other, there is no need to prevent parallel streams of film from sticking to one another in the heat tunnel 26. This reduces the complexity of the machine. As a result, changeover is improved because the "spreader bars" (web turning bars) do not need to be adjusted to different positions to pull the parallel streams of film apart. In addition, fewer "missing film" detection devices are required. Film perforation also provides for improved "film registration" (graphics printed on the film) positioning (around the girth of the package) since one stream of perforated film is being used rather than two or more side by side streams of cut film. Also, the "squareness" or film positioning around the package (the length of the tube) is more controllable.

A suitable apparatus used in the present invention is generally shown in the Figures as reference numeral 310.

The apparatus 310 for perforating and slitting heat shrink film F, comprises a rotating wheel 320 having a plurality of teeth 322 about the circumference of the wheel, the teeth engaging the heat shrink film F, and a film slitter 340. The teeth 322 engage the heat shrink film in a direction substantially parallel to the motion of the film as the film moves past the apparatus 310.

The teeth 322 are pointed to pierce the film F and then slice as they penetrate further.

The teeth 322 are preferably sharpened on both sides to prevent the film from tracking to one side as the wheel 320 engages the film F.

Preferably, the motion of the film F successively engaging the teeth 322 causes the wheel 320 to rotate. Other arrangements are possible, however, such as independent wheel rotation by a motor (not shown).

The film perforations 22 are preferably created by making dull portion 324 on the wheel 320. As the dull portion 324 engages the film F, the film F is not cut.

Preferably, the dull portions 324 are created by grinding a notch 326 between teeth 322. Alternatively, one could also grind away an entire tooth or multiple teeth.

Preferably, the knife has 60 teeth. If one desires they can notch every 2nd tooth, or every 3rd, 4th, 5th, 6th, 10th, 12th, 15th, 20th, or 30th tooth, and thus create a uniform repeating pattern of perforations in the film. The number 60 is 'highly factorable' in that it can be divided into many possible whole number combinations.

Preferably, the wheel has cutouts 328 to reduce inertia. The film speed can change rapidly and the wheel must accelerate easily to match the film which is propelling it. The cutouts 328 also act as finger holes so the wheel does not have to be handled by the sharp points.

Preferably, the wheel is designed to be similar in size to a compact disc. This allows the wheel to be stored in commonly available CD holders.

Preferably, the wheel is mounted on a removable spindle pin 330. The spindle pin acts as a carrier when changing wheels, further reducing the need to handle the wheel. Wheels with different notch patterns can be exchanged when a different perforation pattern is desired.

The film slitter 340 preferably comprises a slitting knife 342. Most preferably, the slitting knife 342 is a common straight razor blade.

The film slitter 340 also preferably comprises an actuator 350 extending the slitting knife 342 against the film F. Most preferably, the actuator 350 is an air cylinder 352.

This cylinder 352 is controlled to extend only during the region of the film which will end up at the bottom of the fully wrapped package.

Preferably, the slitting knife 342 is aligned to follow the same path as the perforation wheel 320.

The slitting knife 342 may make its cut after the perforation wheel 342 has made perforations. Alternatively, the knife 342 may make its cut before the wheel 342 has made perforations.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A method for packaging articles using pre-perforated heat-shrink film, comprising:

(a) creating a line of perforations in a sheet of heat-shrink film;

(b) wrapping the sheet of heat-shrink film around parallel groups of articles spaced apart from one another;

(c) enclosing the parallel groups of articles in the sheet of heat-shrink film with the line of perforations between the parallel groups of articles, thereby forming a continuous sleeve of film with first and second open ends with the line of perforations being spaced from and intermediate the first and second open ends;

(d) conveying the enclosed parallel groups of articles in a conveying direction in an orientation such that the first and second open ends of the sleeve of film are substantially transverse to the conveying direction and the line of perforations is parallel to the conveying direction; and (e) applying heat energy to the conveying enclosed parallel groups of articles to weaken the continuous sleeve of film at the line of perforations, the sleeve then pinching off at the line of perforations and becoming shrunk against the articles.

2. A method for packaging articles using pre-perforated heat-shrink film, comprising:

(a) creating a line of perforations in a sheet of heat-shrink film;

(b) wrapping the sheet of heat-shrink film around parallel groups of articles spaced apart from one another;

(c) enclosing the parallel groups of articles in the sheet of heat-shrink film with the line of perforations between the parallel groups of articles, thereby forming a continuous sleeve of film with first and second open ends;

(d) slitting the heat-shrink film proximate the bottom of the groups of articles;

(e) conveying the enclosed parallel groups of articles in a conveying direction in an orientation; and (f) applying heat energy to the conveying enclosed parallel groups of articles to weaken the continuous sleeve of film at the line of perforations, the sleeve then pinching off at the line of perforations and becoming shrunk against the articles.

3. The method of claim 2, wherein slitting the film is performed with a slitting knife.

4. The method of claim 3, wherein the slitting knife is a razor blade.

5. The method of claim 3, further comprising extending the slitting knife against the film using an actuator.

6. The method of claim 5, wherein the actuator is an air cylinder.

7. The method of claim 2 wherein conveying comprises conveying the enclosed parallel groups such that the first and second open ends of the sleeve of film are substantially transverse to the conveying direction.

8. A method for packaging articles using pre-perforated heat-shrink film, comprising:

(a) creating a line of perforations in a sheet of heat-shrink film;

(b) wrapping the sheet of heat-shrink film around parallel groups of articles spaced apart from one another;

(c) enclosing the parallel groups of articles in the sheet of heat-shrink film with the line of perforations between the parallel groups of articles, thereby forming a continuous sleeve of film with first and second open ends;

(d) conveying the enclosed parallel groups of articles in a conveying direction in an orientation; and (e) applying heat energy to the conveying enclosed parallel groups of articles to weaken the continuous sleeve of film at the line of perforations, the sleeve then pinching off at the line of perforations and becoming shrunk against the articles, wherein creating a line of perforations in a sheet of heat-shrink film comprises moving the sheet of heat-shrink film in a direction of motion of the film, and rotating a wheel having a plurality of teeth about the circumference of the wheel, the teeth engaging the heat shrink film substantially parallel to the direction of motion of the film.

9. The method of claim 8, wherein the teeth are pointed to pierce the film and then slice as they penetrate further.

10. The method of claim 9, further comprising a plurality of dull portions between certain of the plurality of teeth, the dull portions preventing the film from being cut.

11. The method of claim 10, wherein the dull portions further comprise notches between adjacent teeth.

12. The method of claim 11, wherein the number of teeth is sixty and the notches are made between adjacent teeth at intervals corresponding to a factor of sixty.

13. The method of claim 8, further comprising cut-outs in the wheel to reduce inertia and to act as finger grips.

14. The method of claim 8, further comprising storing the wheel is substantially the size of a compact disc, allowing the wheel to be stored in a compact disc case.

15. The method of claim 8, wherein the wheel is mounted on a removable spindle pin.

16. The method of claim 8, wherein the film is slit along the same path as the rotating wheel.

17. The method of claim 16, wherein the knife can be moved out of engagement with the film.

18. The method of claim 8, wherein motion of the film successively engaging the teeth causes the wheel to rotate.

19. The method of claim 8, wherein the rotating wheel can be moved out of engagement with the film.

20. The method of claim 8 wherein conveying comprises conveying the enclosed parallel groups such that the first and second open ends of the sleeve of film are substantially transverse to the conveying direction.

* * * * *

UNITED STATES PATENT AND TRADEMARK OFFICE

CERTIFICATE OF CORRECTION

PATENT NO. : 7,328,550 B2
APPLICATION NO. : 11/185116
DATED : February 12, 2008
INVENTOR(S) : Daniel Leonard Floding et al.

It is certified that error appears in the above-identified patent and that said Letters Patent is hereby corrected as shown below:

Title page, item (75), cancel "Miltons" and substitute therefore --Miltona--.

Column 1, line 27, cancel "conveyorC" and substitute therefore --conveyor C--.

Column 3, line 57, cancel "Fig." and substitute therefore --FIG.--.

Column 3, line 59, cancel "heat-shrink," and substitute therefore --heat-shrink--.

Column 3, line 65, cancel "continuous," and substitute therefore --continuous--.

Signed and Sealed this

Twenty-seventh Day of May, 2008

JON W. DUDAS
*Director of the United States Patent and Trademark Office*